United States Patent [19]

McKeever

[11] Patent Number: 4,838,728

[45] Date of Patent: Jun. 13, 1989

[54] KIT OF HAND-HELD TOOLS FOR MAKING A PATTERNED IMPRESSION IN A CEMENTITIOUS MATERIAL

[76] Inventor: Michael J. McKeever, 8 Alphonsus Rd., Drumcondra, Dublin 9., Ireland

[21] Appl. No.: 140,722

[22] Filed: Jan. 4, 1988

[51] Int. Cl.[4] ..... E01C 23/02

[52] U.S. Cl. ..... 404/89; 425/458; 15/105.5

[58] Field of Search ..... 404/83, 87, 93, 97, 404/118, 124, 133; 425/458; 15/235.3, 235.4, 235.5, 235.6, 235.7, 235.8, 104 S, 105.5

[56] References Cited

U.S. PATENT DOCUMENTS

| | | | |
|---|---|---|---|
| 959,269 | 5/1910 | Starr | 404/93 X |
| 1,436,254 | 11/1922 | Henry, Jr. | 15/105.5 |
| 1,683,373 | 9/1928 | Ross et al. | 15/105.5 |
| 3,109,189 | 11/1963 | Eldridge, Jr. | 15/105.5 |
| 3,406,618 | 10/1968 | Bowman | 404/83 X |
| 3,910,711 | 10/1975 | Moorhead | 404/89 |
| 3,930,740 | 1/1976 | Bowman | 404/93 |
| 4,105,354 | 8/1978 | Bowman | 404/89 X |
| 4,131,406 | 12/1978 | Fresquez | 404/93 X |
| 4,135,840 | 1/1979 | Puccini et al. | 404/93 |
| 4,231,677 | 11/1980 | Roming | 404/89 |

FOREIGN PATENT DOCUMENTS

| | | | |
|---|---|---|---|
| 534502 | 9/1931 | Fed. Rep. of Germany | 404/93 |
| 2095310 | 9/1982 | United Kingdom | 425/458 |
| 2176826 | 1/1987 | United Kingdom | 404/89 |

OTHER PUBLICATIONS

Frederick Tool Corp. brochure, "Quality Lightweight Masonry Tools", (no date).

*Primary Examiner*—Stephen J. Novosad
*Assistant Examiner*—John F. Letchford
*Attorney, Agent, or Firm*—Fleit, Jacobson, Cohn, Price, Holman & Stern

[57] ABSTRACT

A kit of hand-held tools 1, 2, for forming a patterned impression 10 in a cementitious material comprises at least two tools, each having a blade 5 which is pressed into cementitious material using a handle 4. A first tool 1 of the kit for covering larger areas has closed interior patterns 15,16 and open exterior patterns 18, and a second finishing tool 2 of the kit has an open perimeter blade portion 21 or 22.

Each of the blades 5 of the tools 1,2 may be coated with a release agent and/or may be formed with a penetrating tip.

8 Claims, 4 Drawing Sheets

Figure 1:
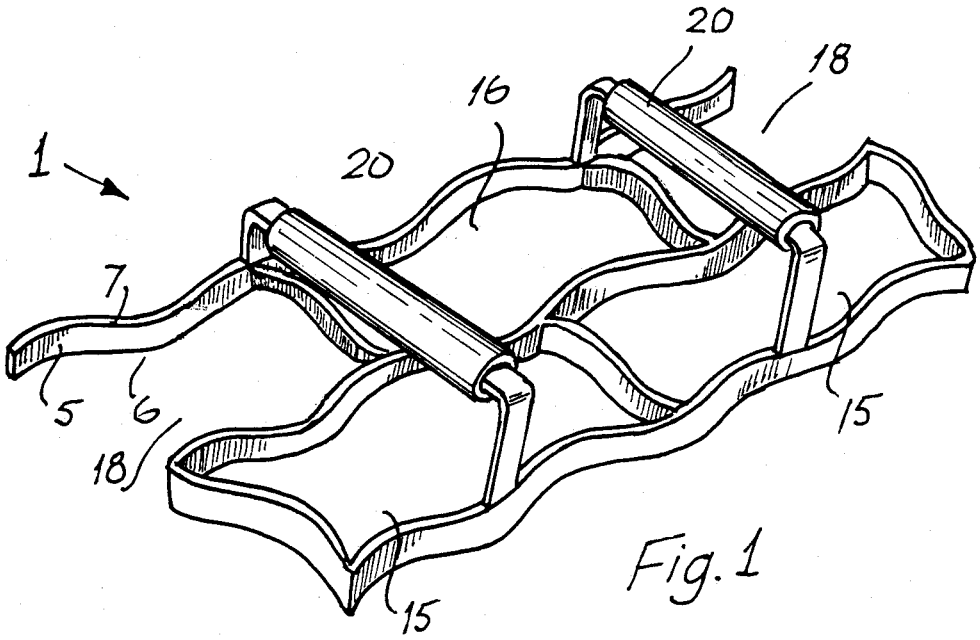

KIT OF HAND-HELD TOOLS FOR MAKING A PATTERNED IMPRESSION IN A CEMENTITIOUS MATERIAL

The invention relates to a kit of hand-held tools for making a patterned impression in a cementitious material.

The term "cementitious material" as used in the specification refers not only to conventional concrete made from portland or alumina cement but also to mortar, plaster and other materials with similar properties which harden on setting.

In making a patio, pathway, or similar area two techniques are generally used. The cheapest and quickest way of filling the area is to lay a concrete mix all over the area on a hard core base. One of the problems with this technique is that the result is a generally dull flat area of concrete without any visual interest. Another technique is to use preformed paving stones or slabs which are laid out in a desired pattern. While this generally results in a more aesthetically pleasing layout, this latter method is both time consuming and expensive.

Similar comments apply to forming facing walls and the like.

Various tools for forming patterned impressions in concrete are known and are described in U.S. Pat. Nos. 4,231,677, 4,135,840, 4,131,406, 4,105,354, 3,930,740, 3,910,711 and 3,406,618.

U.S. Pat Nos. 4,231,677, 4,135,840, 4,131,406 and 3,406,618 all describe various tools for forming patterned impressions, each of which includes a weight supporting platform to which the user applies his weight to drive the tools into a cementitious mass. This leads to a costly construction of tool and because a weight supporting platform is used, there is a substantial risk that the user may apply too much an unbalanced weight to the platform, thus driving a portion of the platform into the cementitious material and spoiling the pattern. Further, the platform generally obscures the pattern being formed and it is difficult to see and lever control the penetration of the pattern forming blade into the cementitious mass.

U.S. Pat. No. 4,105,354 describes a large worker ballasted, propelled and guided wheel-like tool for making patterned impressions. The tool described is both complicated and expensive as well as being extremely difficult to operate.

U.S. Pat. 3,910,711 describes a roller type device which in this case is mechanically driven and suffers from similar disadvantages as the tool of U.S. Pat. No. 4,105,354.

U.S. Pat. No. 3,930,740 describes a number of tools for forming a non-repeating patterned impression. The tools are again of relatively complex and hence expensive construction. The tools are also limited to forming portions of nonrepeating patterns.

According to the invention there is provided a kit of hand-held tools for forming a repeating patterned impression in a cementitious material comprising at least two tools, each of the tools comprising shaped blade means arranged in a desired pattern and a handle extending from the blade means for pressing the blade means into the cementitious material, each blade means being substantially rectilinear in transverse cross-section and including a lower cementitious material penetrating portion and an upper tamping surface, a first tool of the kit having a blade means arranged in at least one closed interior pattern and at least one exterior open pattern shaped to conform with a portion of the interior pattern, and a second tool of the kit having an open perimeter blade means shaped to conform with a portion of the closed interior pattern of the first tool.

Preferably, the handle of the first tool is of substantially inverted U-shape, the legs of the U being fixed to the upper tamping surface of the blade means.

In one embodiment of the invention, the second tool comprises a shank, a first blade means at one end of the shank, and a second blade means at the other end of the shank, the first and second blade means being shaped to conform with different portions of the closed interior pattern of the first tool.

In one embodiment of the invention, the blade means of each tool is coated with a release agent.

In one embodiment of the invention, the sides of each blade means, taper downwardly and terminate in a penetrating tip of generally inverted V-shaped crosssection.

In one embodiment of the invention the open exterior pattern corresponds to approximately half of the closed interior pattern.

Preferably the first tool comprises a pair of lower closed interior patterns, an upper closed interior pattern extending over a portion of the pair of lower closed interior patterns and a pair of open exterior patterns flanking the upper closed interior patterns.

Figure 6:
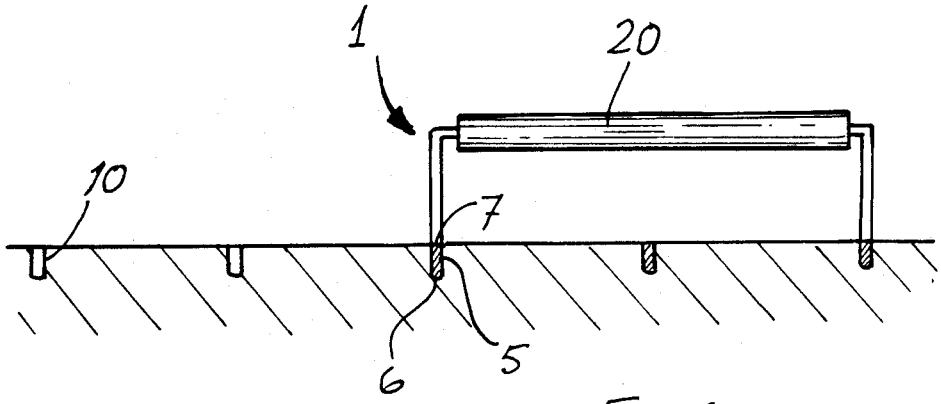
Figure 2:
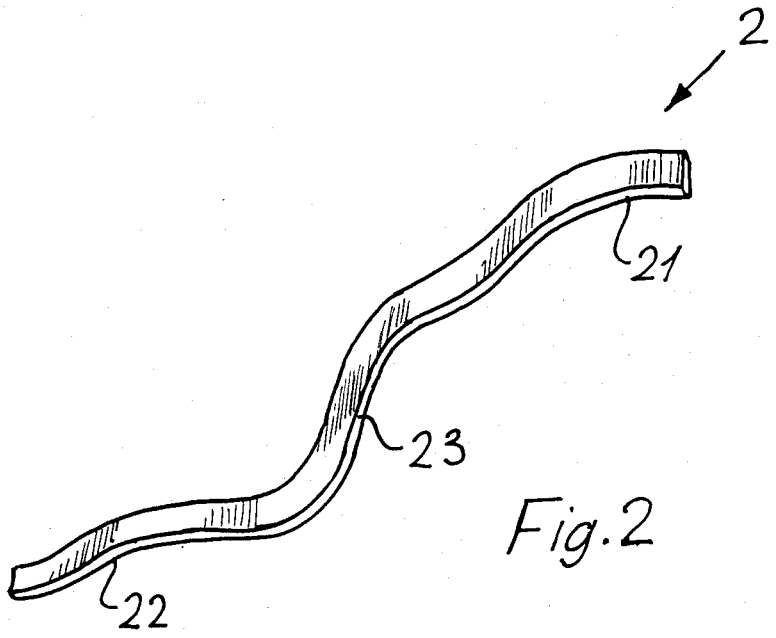
Figure 3:
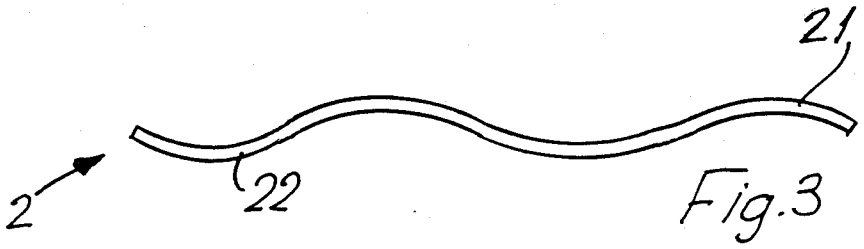
Figure 4:
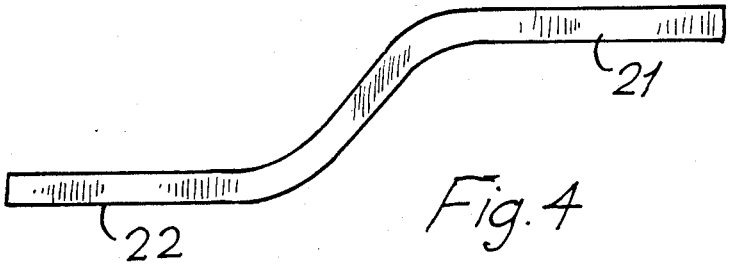
Figure 5:
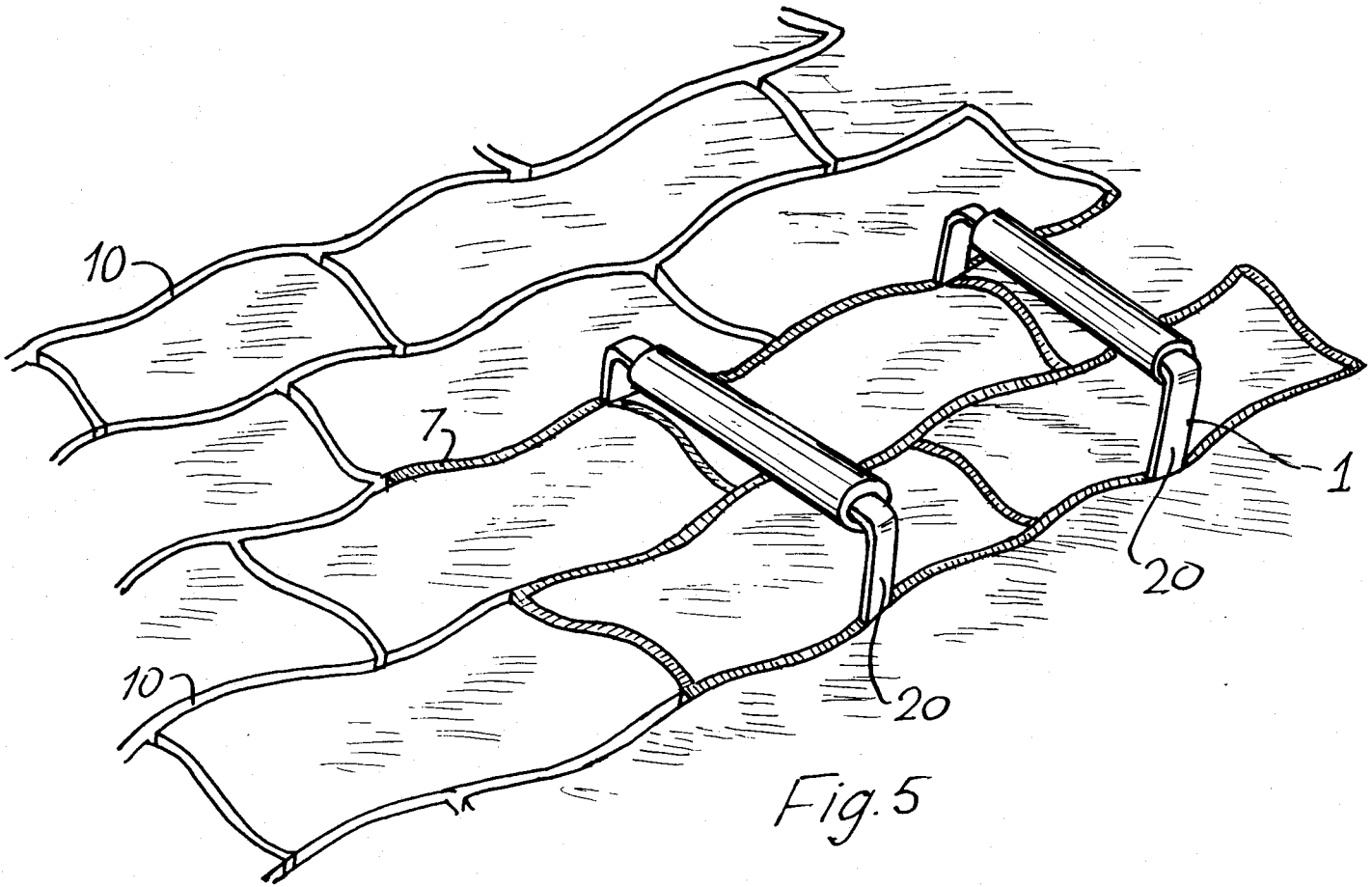
Figure 7:
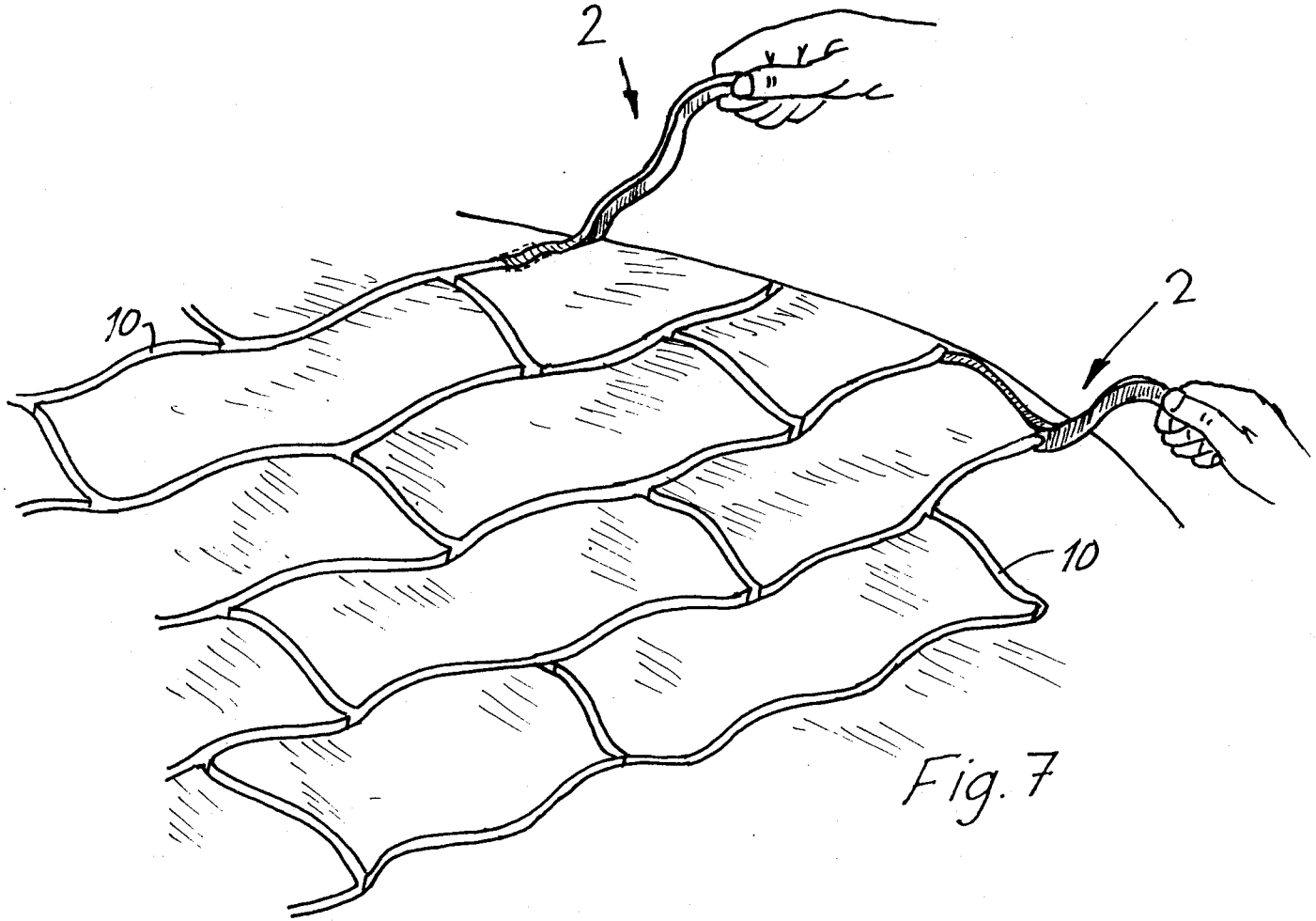

The invention will be more clearly understood from the following description thereof given by way of example only with reference to the accompanying drawings in which:

FIG. 1 is a perspective view of a first hand-held tool of a kit for making a patterned impression in a cementitious material, according to the invention, FIG. 2 is a perspective view of a second hand-held tool of the kit, FIG. 3 is a plan view of the tool of FIG. 2, FIG. 4 is a side elevational view of the tool of FIG. 2, FIG. 5 is a perspective view of the tool of FIG. 1, in use, FIG. 6 is a cross sectional view of the tool of FIG. 1, in use, and FIG. 7 is a perspective view of a portion of a patio or pathway having a pattern of stamped impressions made using the kit of tools of FIGS. 1 to 4.

Referring to the drawings thereof there is illustrated a kit of tools according to the invention for making patterned impressions in a cementitious material. The kit comprises a first tool 1 and a second tool 2. A paving area such as a patio having patterned impressions 10 made using the tools 1,2 is illustrated in FIGS. 5 and 7. The first tool 1 of the kit comprises a blade means 5 of substantially rectilinear cross-section including a lower cementitious material penetrating portion 6 and an upper surface 7. The blade means 5 is formed from strip steel material ½" by 3/16". To assist insertion and withdrawal of the blade 2 into and out of the cementitious material at least the lower penetrating portion 6 of the blade 2 may be coated with a release agent such as an oil based paint. Preferably the blade is covered with the release agent. Alternatively, or additionally, the penetrating portion 6 of the blade 5 may comprise a penetrating tip or point for engaging the cementitious material. In this case, the blade means may comprise a pair of sides which taper downwardly and terminate in a lower penetrating tip with a generally V-shaped crosssection.

The blade means 5 in this case is arranged in closed interior patterns and open exterior patterns. In this case there are two lower closed interior patterns 15 and a central upper interior pattern 16 bridging the lower interior patterns 15. Each interior pattern is in the shape of a paving stone, and each pattern is of the same size and shape as the other. The exterior pattern is in the form of two open exterior patterns 18 flanking the upper interior pattern 16 and each forms a half portion of a paving stone of the same size and shape.

Means for pressing the tool 1 into cementitious material to make the patterned impression is in this case provided by two handles 20 of inverted U-shape welded to the upper surface 7 of the blade.

The second tool 2 comprises a pair of spaced-apart shaped blades namely an open perimeter paving stone blade portion 21 and a shorter open perimeter paving stone blade portion 22 which are joined by a central shank 23. The blade portions 21,22 are shaped to conform with a portion of the paving stone pattern of the first tool. When the blade portion 21 is lowermost the blade portion 22 forms a handle and vice versa. The blade portions 21,22 are of the same construction as the blade means 5 of the tool of FIG. 1.

In use, the kit of tools of FIGS. 1 to 4 are used to form the paving stone patterned patio design illustrated in FIGS. 5 and 7. A conventional concrete mixture is poured onto a hard core base and is tamped and levelled in the usual way. While the cementitious material is still plastic, the tools 1, 2 are used to form the desired pattern. In each case, the tool 1, 2, is pressed downwardly by hand into the concrete mix to make the desired shape. If necessary, the tool may be tamped by striking the upper surface 7 of the blade 5. For larger areas the first tool 1 of FIG. 1 is used, the open perimeter portions 18 of patterned impression made by the tool 1 engaging with open perimeter portions made by an adjacent impression of the same tool 1 to form a closed perimeter impression. To continue the pattern in smaller areas where access is limited the second perimeter tool 2 of FIGS. 2 to 4 is used.

The appropriate blade portion 21,22 is fitted into the groove formed by the open perimeter pattern 18 and continued beyond the impression formed by the first tool as illustrated in FIG. 7. In this way the same pattern is continued as the blade portions 21,22 form part of the paving stone pattern used in the first tool 1.

The second tool 2 is also used to clean the joints between the impressions made by the tool 1, the appropriate blade portion 21,22 being pressed into the groove to clean any rough edges.

Thus, the kit of tools according to the invention facilitate the formation of an aesthetically pleasing pattern for a patio or other area both cheaply and quickly.

The kit of tools are lightweight and easy to handle. The second tool may be readily carried by the user in a belt or pocket while the first tool is sufficiently light, typically about three pounds weight to be readily carried and easily manipulated.

Many patterns other than those illustrated will be readily apparent and it will be appreciated the shape of the tools depends on the pattern whcch it is desired to produce using the kit.

It will be appreciated that while the invention has been specifically described with reference to patio designs the kit of tools according to the invention may be used in forming impressions in cementitious materials in other locations such as for a flat roof, a facing wall or the like.

It will be appreciated that in some cases the tools may include an enlarged upper tamping anvil or striking surface to allow the tools to be more readily tamped into a cementitious material to make the desired impression.

I claim:

1. A kit of hand-held tools for forming a repeating patterned impression in a cementitious material, comprising at least two tools, each of the tools comprising consisting of shaped blade means arranged in a desired pattern to be impressed into a cementitious material to form said desired pattern therein, and a handle extending from the blade means for holding and pressing the blade means into the cementitious material for forming said desired pattern therein, each said blade means being comprised of blades which are substantially rectilinear in transverse cross-section and which have a lower cementitious material penetrating portion and an upper tamping surface, a first tool of the kit consisting of a blade means wherein the blades are arranged in at least one closed interior pattern and at least one exterior open pattern shaped to conform with a portion of the interior pattern, the first tool having no platform means and wherein said handle extends directly from the upper tamping surface of the blades of the blade means thereof, and a second tool of the kit having an open perimeter blade means shaped to conform with a portion of the closed interior pattern of the first tool.

2. A kit as claimed in claim 1 wherein the handle of the first tool is of substantially inverted U-shaped, the legs of the U being fixed to the upper surface of the blade means.

3. A kit as claimed in claim 1, wherein the second tool comprises a shank, a first blade means at one end of the shank, and a second blade means at the other end of the shank, the first and second blade means being shaped to conform with different portions of the closed interior pattern of the first tool.

4. A kit as claimed in claim 1 wherein the sides of each blade means taper downwardly and terminate in a penetrating tip of generally inverted V-shaped cross-section.

5. A kit as claimed in claim 1 wherein the blade means of each tool is coated with a release agent.

6. A kit as claimed in claim 5 wherein the release agent is an oil-based paint.

7. A kit as claimed in claim 1 wherein the open exterior pattern corresponds to approximately half of the closed interior pattern.

8. A kit as claimed in claim 7 wherein the first tool comprises a pair of lower closed interior patterns, an upper closed interior pattern extending over a portion of the pair of lower closed interior patterns and a pair of open exterior patterns flanking the upper closed interior pattern.

* * * * *